US006217693B1

(12) United States Patent
Pelham

(10) Patent No.: US 6,217,693 B1
(45) Date of Patent: Apr. 17, 2001

(54) METHOD OF MAKING NONWOVEN LOOP MATERIAL FOR HOOK AND LOOP FASTENERS

(75) Inventor: Matthew C. Pelham, Buford, GA (US)

(73) Assignee: YKK Corporation of America, Marietta, GA (US)

( * ) Notice: Subject to any disclaimer, the term of this patent is extended or adjusted under 35 U.S.C. 154(b) by 0 days.

(21) Appl. No.: 09/363,923

(22) Filed: Jul. 30, 1999

Related U.S. Application Data

(60) Provisional application No. 60/095,428, filed on Aug. 5, 1998.

(51) Int. Cl.[7] ..... B32B 31/00

(52) U.S. Cl. ..... 156/229; 156/167; 428/100

(58) Field of Search ..... 156/160, 161, 156/229, 62.2, 181, 167; 428/100; 24/442, 445, 447, 448, 450, 451

(56) References Cited

U.S. PATENT DOCUMENTS 5,547,531 * 8/1996 Allen et al. ..... 156/229 X
5,569,233 * 10/1996 Goulait ..... 428/100 X
5,595,567 * 1/1997 King et al. ..... 24/442 X

* cited by examiner

*Primary Examiner*—Jeff H. Aftergut
(74) *Attorney, Agent, or Firm*—Finnegan, Henderson, Farabow, Garrett & Dunner, L.L.P.

(57) ABSTRACT

A method for making loop material for hook and loop fasteners comprising the steps of forming a nonwoven web of randomly deposited nonelastomeric thermoplastic fibers, wherein the nonwoven web has a front side and a back side. Wherein the web is the consolidated by stretching the web in an x direction and then stretching the nonwoven web in a y direction thereby creating looped fibers, a majority of which are in an "x-y" plane. And wherein fluid is passed through the nonwoven web in a "z" direction and then stabilized in the "z" direction.

13 Claims, 4 Drawing Sheets

METHOD OF MAKING NONWOVEN LOOP MATERIAL FOR HOOK AND LOOP FASTENERS

I hereby claim the benefit under 35 U.S.C. § 119(e) of United States provisional application Ser. No. 60/095,428 filed Aug. 5, 1998.

FIELD OF INVENTION

The present invention relates to a method of making nonwoven loop material for hook and loop fasteners. More particularly, the invention relates to a method of making nonwoven loop material that has minimal directional preference, is capable of engaging with hook components having various sizes and shapes, at a reduced manufacturing cost.

BACKGROUND OF INVENTION

Hook and loop fasteners are used when it is desirable to create a refastenable bond between two or more surfaces, such as in clothing or disposable absorbent articles. These fasteners are used in place of buttons, snaps, or zippers.

In general, hook and loop fasteners have a male component and female component. The female component contains numerous upstanding loops on its surface while the male component contains hooks that mechanically engage the female loops, thereby creating a refastenable bond.

Conventionally, nonwoven loop material for hook and loop fasteners is formed of a nonwoven web having a number of loops. The nonwoven web is then attached to a backing material and the loops extend therefrom.

The male component contains a plurality of resilient, upstanding hook-shaped elements. When the male component and the female component are pressed together in a face-to-face relationship to close the fastening device, the male component hooks entangle the female component loops forming a plurality of mechanical bonds between the individual hooks and loops. When these bonds have been created, the components will not generally disengage under normal conditions. This is because it is very difficult to separate the components by attempting to disengage all the hooks at once. However, when a gradual peeling force is applied to the components, disengagement can be easily effected. Under a peeling force, since the hooks are comprised of a resilient material, they will readily open to release the loops.

Manufacture of this type of device is relatively costly.

Conventional hook and loop components are typically formed by making a fabric with a number of woven loops extending outwardly from a backing. The loops may be provided by weaving a base fabric containing supplementary threads to form the loops, or by knitting the loops into a fabric. In other hook and loop components, the loops may be formed by pleating or corrugating processes. The male components of such fastening devices are typically formed by subsequently cutting the loops. The cut loops serve as the hooks of the male component.

These processes generally produce costly hook and loop fastening materials because they are relatively slow. The hook and loop components of such fastening devices are also usually made out of the same relatively expensive material. This material is expensive because the material used in the male component needs to be resilient so that the hooks can disengage from the loop component when the device is open.

In addition, materials made by these processes tend to produce loops having a small area underneath the fiber such that inserting a hook is difficult. Further, the loops tend to have a directional preference, thereby making insertion of the hooks into the loops more difficult. That is, the loops manufactured using conventional methods may tend to lay in one direction such that hooks that point in a different direction will be less likely to engage the loops.

Attempts have been made to make alternative types of female components for fastening devices.

One such attempt is a method for making a nonwoven female component for hook and loop fasteners in which the fastening material is formed by stretching the backing material for the loops in the machine direction prior to application of the nonwoven web. The nonwoven web is then applied to the stretched backing. The stretched backing is then allowed to relax, causing the nonwoven web to bunch such that the loops may be sheered to form catching regions capable of entangling the hooks of a complementary male fastening component. The female components described therein do not appear to be significantly less expense to manufacture than conventional loop components. And, the area underneath the loops is not increased in size to facilitate insertion of the hooks.

In another attempt at making loops for hook and loop fasteners where the loops are joined to a substrate, the loops are manufactured by the process of extruding liquid material through the apertures of a depositing member onto a moving substrate to form the base of the loop, stretching the liquid material in a direction parallel to the plane of the substrate, severing the stretched material to form a distal end which fuses with an adjacent amount of stretched material to form a loop. Such a method does not appear to reduce the cost of manufacture of loops, or increase the area underneath the loops to facilitate hooking.

In still another attempt, generally used in the area of fasteners for disposable diapers, conventional female components for hook and loop fasteners use various relatively tricot knit material; however, they are costly and have various drawbacks because of their manufacturing processes and characteristics. Usually, a loop component is made by a napping or brushing process, or a needle punch process, which requires sensitive energy control in order to not cut the fibers of the loop component. In particular, when the loop fibers are thin in order to match them with relatively small size hooks, greater sensitivity is required. Moreover, knit material inherently tend to have a directional preference due to their manufacturing processes and therefore limit the size or shape of hook components engageable with such tricot knit loop components.

SUMMARY OF THE INVENTION

Accordingly, the present invention is directed to a method of making nonwoven loop material for hook and loop fasteners that substantially obviates one or more of the problems due to the limitations and disadvantages of the related art.

To achieve the foregoing advantages and in accordance with the purpose of the invention, as embodied and broadly described, the invention is a method of making loop material for hook and loop fasteners comprising the steps of forming a nonwoven web of randomly deposited nonelastomeric thermoplastic fibers. The nonwoven web is consolidated by stretching the web in an "x" direction. The web is then stretched in a "y" direction, thereby creating loop fibers, a majority of which are in the "x-y" plane. Fluid is then passed through the nonwoven web in a "z" direction. The nonwoven web is then stabilized in the "z" direction.

In another aspect, the invention includes a method of making a loop material for hook and loop fasteners comprising a nonwoven web consisting of randomly deposited nonelastomeric thermoplastic fibers. The nonwoven web is consolidated by stretching the web in the machine direction thereby creating loop fibers, a majority of which are in the "x-y" plane. The nonwoven web is then stretched in the cross-machine direction, increasing the pore size of the fiber pattern in the web. Melt-blown polymer fibers are then applied to the back of the nonwoven web using a high velocity, hot air process. This process causes the loops to protrude and then be stabilized in the "z" direction.

In yet another aspect, the invention includes a method of making loop material for hook and loop fasteners comprising a nonwoven web consisting of randomly deposited nonelastomeric thermoplastic fibers. The nonwoven web is consolidated by stretching the web in the machine direction thereby creating looped fibers, a majority of which are in the "x-y" plane. The nonwoven web is then stretched in the cross-machine direction while melt-blown is applied to the back of the nonwoven web such that the looped fibers are protruding and stabilized in the "z" direction.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention and are incorporated and constitute a part of this specification. The drawings illustrate several embodiments of the invention and together with the description serve to explain the principles of the invention. In the drawings.

DETAILED DESCRIPTION OF THE PREFERRED EMBODIMENTS

Reference will now be made in detail to the present preferred embodiments of the invention, examples of which are illustrated in the accompanying drawings.

The term "nonwoven" as used herein means randomly laid fibers or filaments to form a web wherein some of the fibers are bonded by fiber-to-fiber fusion or fiber entanglement or thermobonds as by point bonding. The term "pore size" means a quantification of the physical dimensions of channels oriented in a generally normal direction to the plane of the web.

The present invention described with specific reference to the preferred webs will be melt-blown webs. It is to be emphasized, however, that the method and product produced thereby includes other nonwoven webs, specifically spunbond, hydroentangled, needled webs, and laminated combinations of these.

Figure 8:
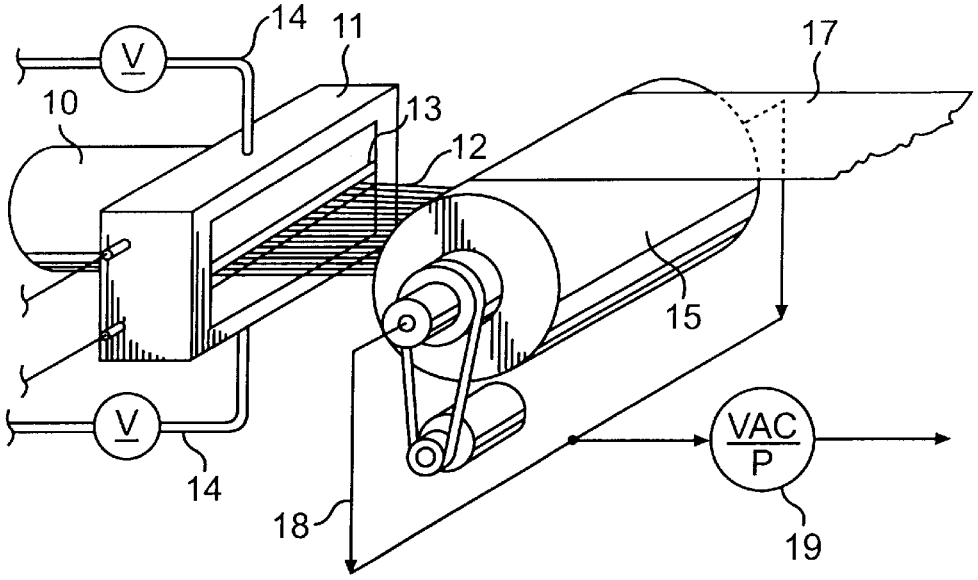
FIG. 8 is a schematic depicting a melt-blowing process.

Melt-blowing is a well-known process which generally utilizes equipment depicted in the schematic of FIG. 8. The process is carried out by introducing a thermoplastic resin into an extruder 10 where the polymer is heated, melted, and extruded through a die 11 to form a plurality of side-by-side filaments 12 while converging layers of hot air, discharging from slots 13 on each side of the row filaments, contact the filaments and through drag forces stretch and attenuate the filaments 12 to a micron-size. The fibers 12 are collected onto a collector such as a rotating screen 15 forming a nonwoven web 17 which may be withdrawn on a take-up roller for later processing. The collector 15 may include a vacuum screen wherein a vacuum 18 is drawn through a line by a vacuum pump 19.

The hot air (primary jet air) is introduced into opposite sides of the die through line 14. Secondary air, which is aspirated into the primary air front/fibers stream serves to cool the filaments discharging from the die 11.

Figure 4:
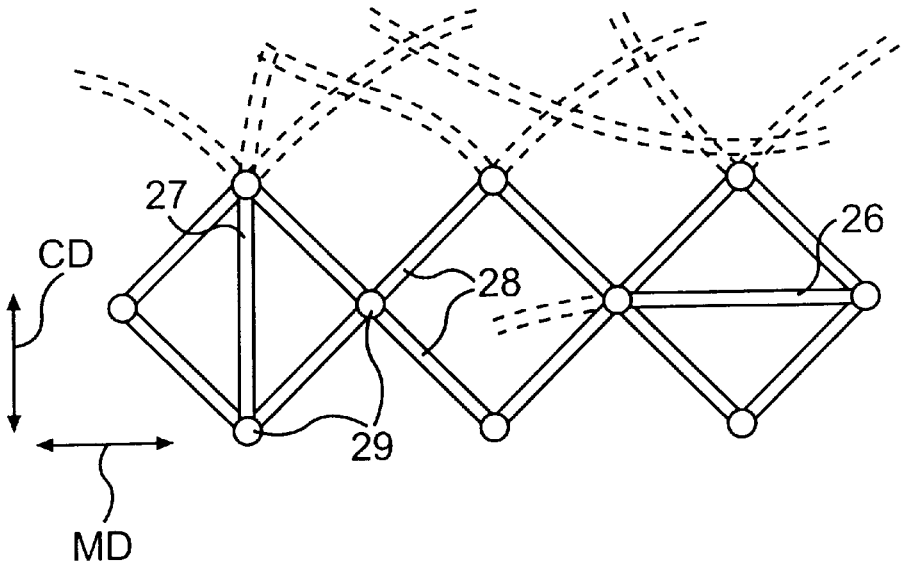
FIG. 4 is a plan view of the fibers of the nontreated nonwoven web.
Figure 5:
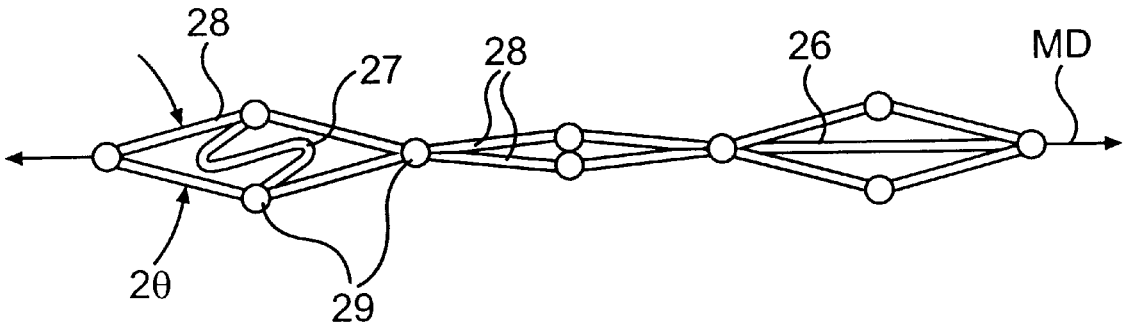
FIG. 5 is a perspective of the fibers of the nonwoven web produced by the method of this invention.

A web produced by the method above is illustrated in FIG. 4. In the idealized representation or model in FIG. 5, the fibers 26, 27, and 28 are shown interconnected or bonded as a loose network at junction 29 of the fibers. It is to be emphasized that the bonds are fuse bonded during the melt blown process, or by fiber entanglement, or by thermal point calendaring techniques. When the web structure shown in FIG. 4 is subjected to tension in the machine direction, the intermediate fibers 28 are easily aligned in the machine direction thus reducing pore dimensions, whereas the cross machine direction fibers 27 tend to resist compression of the cell in which it is associated and may buckle and bend as illustrated in FIG. 5. The result is that the lateral consolidation of the precursor web, in accordance with the present invention, leaves pore space throughout the web layer, which depends on the extent to which cross machine direction fibers are buckled.

Figure 1:
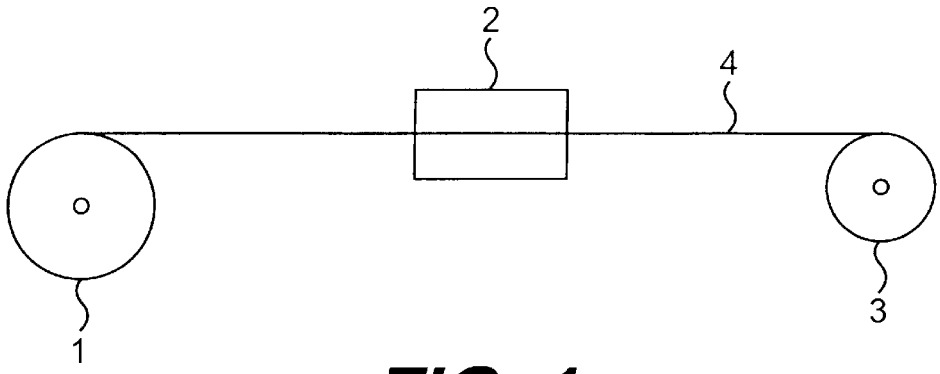
FIGS. 1–3 are schematics of the apparatus for the practice of the present invention.
Figure 2:
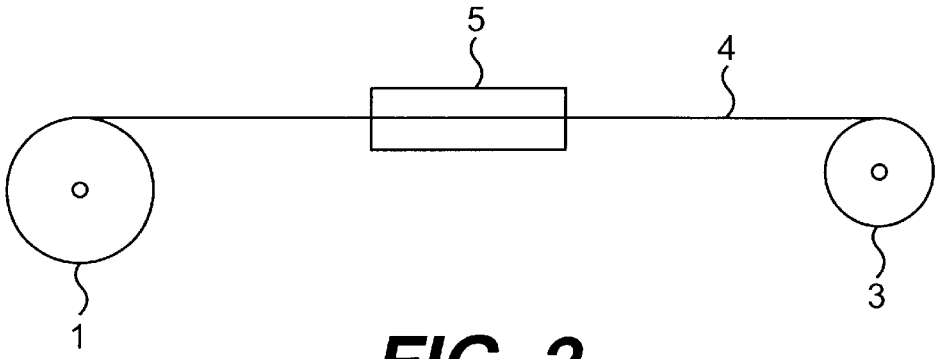
Figure 3:
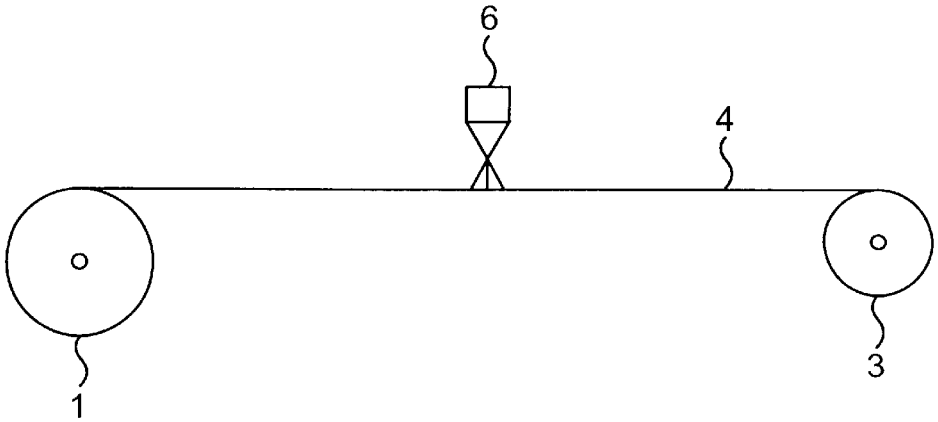

As shown in FIGS. 1–3, this invention includes: an unwind roll 1, an oven 2, a rewind roll 3, a web 4, a cross-machine stretcher (tenter) 5; and a melt-blown die 6.

The unwind roll 1, oven 2, rewind roll 3, cross-machine stretcher 5, and melt-blown die 6, are all common equipment used in the field of nonwoven web processing and can easily be selected by one skilled in the relevant art.

In a method of making loop material for a hook and loop fastener of the present invention, a nonwoven web is stretched in a first direction, wherein the stretch range is approximately 30 to 80 percent. The nonwoven web is then stretched in a second direction, wherein the stretch range is approximately 70 to 150 percent. After the nonwoven web has been stretched in the first and second direction, looped fibers 26, 27, or 28 will exist in the web.

The first direction, x, and the second direction, y, can be any two substantially perpendicular directions in the "x-y" plane. In one embodiment, the first direction is the machine direction while the second direction is the cross-machine direction. In a second embodiment, the first direction is the cross-machine direction, while the second direction is the machine direction. One skilled in the art of processing nonwoven webs would understand the many stretch directions available to accomplish the looped fibers 26, 27, and 28 of this invention. For example, the first direction can be substantially parallel to the machine direction, while the second direction can be substantially perpendicular to the machine direction. In another example, the first direction could be diagonal across the nonwoven web while the second direction is diagonal in the opposite direction.

After the nonwoven web is stretched in the first and second direction, the web 4 is stabilized to maintain the structure of the looped fibers 26, 27, and 28. The web 4 may be stabilized in a number of ways known to those skilled in the art, such as applying melt-blown or an extrusion layer to the backing, or by fixing the web directly to the surface of the garment or article for which it is produced. For example, the nonwoven web 4 can be fixed directly to the surface of an absorbent article, such as a diaper. In such an instance, the fastening strip is affixed to the backing surface of the absorbent article. The method of the present invention allows the formation of a partial catching region where only the loops, and not the backing surface, are capable of entangling the hooks.

In one embodiment, prior to stabilizing the web, it is preferred that high velocity air be blown through the back of the nonwoven web, wherein the high velocity air has a velocity of approximately 50 to 120 pounds per square inch (psi). This will cause the looped fibers 26, 27, and 28 to protrude in the "z" direction. It may also be preferred that an adhesive be applied to the back of the nonwoven web 4 prior to application of the melt-blown.

In a more preferred method of making loop material for a hook and loop fastener of the present invention, as shown in FIG. 1, a nonwoven web 4 is transferred from an unwind roll 1 to a rewind roll 3. The nonwoven web 4 is comprised of randomly deposited nonelastomeric thermoplastic fibers.

The nonwoven web 4 can be made of a variety of materials, the selection of which would be obvious to one skilled in the art. For example, the nonwoven web 4 could be made of polyester or polypropylene. Also, the nonwoven web 4 itself could be fabricated in a variety of manners, such as by a spunbond process. Such processes are known to those skilled in the art.

In a preferred embodiment, the nonwoven web is constructed of polypropylene or polyester fibers and has a weight of approximately 20 to 40 grams/meter$^2$. It is further preferred that the nonwoven of polypropylene or polyester fibers have a weight of 25 to 35 grams/meter. As the nonwoven web 4 is transferred from the unwind roll 1 to the rewind roll 3, the nonwoven web 4 passes through an oven 2. For a polypropylene nonwoven web, it is preferred that the oven have a temperature of approximately 135 to 140 degrees C. For a polyester nonwoven web, it is preferred that the oven have a temperature of approximately 220 to 230 degrees C. The oven 2 enhances the ability of the nonwoven web 4 to stretch. It is important to note that heat may be applied in the machine direction as well as the cross machine direction. The stretching of the nonwoven web 4 in the machine direction is accomplished as the unwind roll 1 unwinds the nonwoven web 4 at speeds from 100 to 300 feet per minute (fpm) while the rewind roll 3 takes up the nonwoven web 4 at speeds of 140 to 600 fpm, with the unwind roll 1 moving at a slower speed than the rewind roll 3, the selected speed differential determining the amount of stretch. It is preferred that the draw ratio, i.e., the final length/original length, be approximately 1.4 to 2.0. For a more detailed understanding of this step, reference is made to U.S. Pat. No. 5,244,482, which patent is incorporated by reference. Stretching the web in the machine direction creates fiber loops 26, 27, and 28 in the "x-y" plane as shown in FIG. 5.

As shown in FIG. 2, after the nonwoven web 4 is stretched in the machine direction, it is then stretched in the cross-machine direction. In this step the nonwoven web 4 is transferred from an unwind roll 1 to a rewind roll 3, while passing through a pin tenter 5. As noted above, heat may be applied as the nonwoven web is stretched in the cross-machine direction. This can be accomplished by placing the pin tenter 5 in the oven 2.

Figure 6:
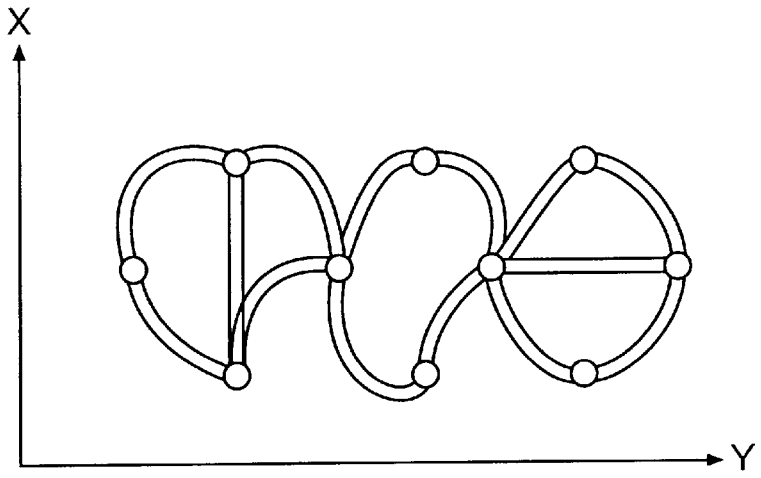
FIG. 6 is a detailed view in the "x-y" plane of the fibers produced by the method of this invention.
Figure 7:
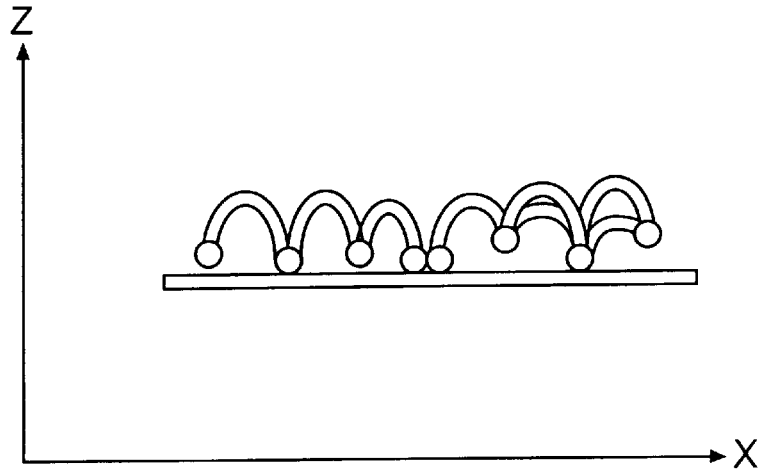
FIG. 7 is a detailed view in the "x-z" plane of the fibers produced by the method of the invention.

It is preferred that the cross-machine stretch be approximately 100–200% of the original cross-machine size. It is further preferred that the cross-machine stretch be 150%. While the nonwoven web 4 is stretched in the cross-machine direction, high velocity air is blown through the backing of the nonwoven web 4 (see FIG. 3), pushing the loops 26, 27, or 28 upward in the "z" direction as shown in FIG. 6. The loops are then stabilized in the "z" direction by spraying melt-blown on the back of the nonwoven web 4.

In another embodiment, while the nonwoven web 4 is in a cross-machine stretched condition, a large-hole support screen is placed behind the web. It is preferred that hole support screen be ¼" to ½" hardwire cloth. While the hardwire cloth is placed against the web 4, the web 4 is passed through the meltblown, where high velocity air pushes the loop in the "z" direction and meltblown is sprayed on the back of the nonwoven web, such that the loops are stabilized.

In yet another embodiment of the method of this invention, the steps of blowing high velocity air through the nonwoven web 4 and stabilizing the loops in the "z" direction by spraying melt-blown on the back of the nonwoven web 4 are performed in one step. The loop fibers are thereby pushed into the "z" direction and stabilized in one step as the melt-blown polymer fibers are sprayed onto the back of the nonwoven web 4 using a high velocity, hot air process, after the nonwoven web 4 has been stretched in both the machine direction and the cross-machine direction.

In yet another embodiment of the method of this invention, the steps of stretching the nonwoven web 4 in the cross-machine direction and causing the loop fibers to protrude in the "z" direction are combined. In this embodiment, after the nonwoven web 4 is drawn in the machine direction, it is drawn in the cross-machine direction by passing it through the tenter 5, while melt-blown polymer fibers are sprayed onto the back of the nonwoven web 4 using a high velocity, hot air process.

In still another embodiment of the present invention the nonwoven web is skewed as it is stretched. Assuming that the "y" direction is machine direction, skewing of the web is achieved by pulling one side of the nonwoven web at a faster pace than the other side as the web is being stretched in the machine direction. In still a more preferred embodiment, the nonwoven web is overfed as the web is stretched in the machine direction. It is preferred that the fabric should be skewed from between 10 to 80 degrees.

Figure 9:
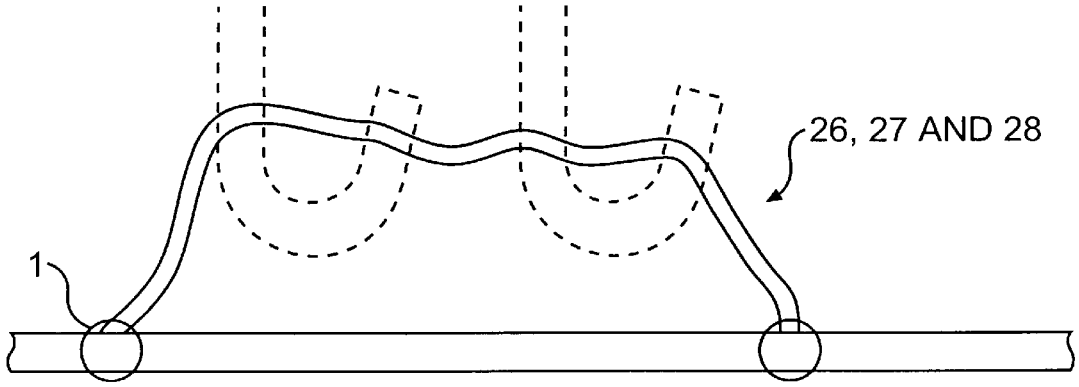
FIG. 9 is a detailed view in the "x-y" plane of the fibers produced by the method of the invention.

As well as being less costly to manufacture, the loops produced by the methods described above overcome other disadvantages associated with those produced by the methods of the prior art. The loops of the present invention do not have a directional preference. In addition, the area under the fiber loops of the present invention, as illustrated in FIG. 9 are generally longer and wider than the area formed by conventional methods, thereby allowing the loop fiber to catch more hooks. Moreover, the size of the loops can be optimized by adjusting the stretching tension that is applied to the loop web. The tension can be adjusted in either the machine direction or the cross-machine direction. When the size of the hooks is smaller, smaller loops are preferred so that the hooks can catch more loops. Thus, when smaller loops are preferred, the stretching tension to the loop web should be reduced.

The loop materials produced by the method of the present invention are expected to have a peeling strength of approximately 50–150 grams/cm$^2$ and a shearing strength of approximately 200–400 grams/cm$^2$. Such peeling and shearing strengths are generally only foound in hook and loop fabrics manufactured using the more costly conventional methods.

It will be apparent to those skilled in the art that various modifications and variations can be made in the method of the present invention without departing from the spirit or scope of the invention. Thus it is intended that the present invention cover the modifications and variations of this invention provided that they come within the scope of the appended claims and their equivalents.

What is claimed is:

1. A method for making loop material for hook and loop fasteners comprising the steps of:

forming a nonwoven web of randomly deposited nonelastomeric thermoplastic fibers, wherein the nonwoven web has a front side and a back side;

consolidating the nonwoven web by stretching the web in an x direction;

stretching the nonwoven web in a y direction thereby creating looped fibers, a majority of which are in an "x-y" plane;

passing fluid through the nonwoven web in a "z" direction; and stabilizing the stretched nonwoven web in the "z" direction.

2. The method of claim 1 wherein the step of passing fluid comprises blowing high velocity air through the nonwoven web, the air being blown through the back side of the nonwoven web, pushing the looped fibers in the "z" direction.

3. The method of claim 1 wherein the step of stabilizing the stretched nonwoven web comprises applying melt-blown polymer fibers onto the back side of the nonwoven web using a high velocity, hot air process.

4. The method of claim 1 wherein the step of stabilizing the stretched nonwoven web comprises applying melt-blown polymer fibers onto the back side of the nonwoven web using a high velocity, hot air process while stretching the nonwoven web in the second direction y.

5. The method of claim 1 wherein the step of passing fluid comprises blowing high velocity air through the nonwoven web, the air being blown through the back side of the nonwoven web, pushing the looped fibers in the "z" direction, and wherein the step of stabilizing the stretched nonwoven web comprises fixing the nonwoven web directly to a surface.

6. The method of claim 1 wherein the first direction x is in the machine direction.

7. The method of claim 1 wherein the second direction y is in the cross-machine direction.

8. The method of claim 1 wherein the nonwoven web is stabilized in the "z" direction by spraying melt-blown onto the back of the nonwoven web.

9. The method of claim 1 wherein the nonwoven web is spunbond.

10. The method of claim 9 wherein the nonwoven spunbond web is polypropylene.

11. The method of claim 10 wherein the nonwoven spunbond web is polyester.

12. The method of claim 1 where adhesive is applied to the back of the nonwoven web prior to the application of the melt-blown.

13. The method of claim 1 where the nonwoven web is skewed in the "x-y" plane to induce the individual looped fibers to agglomerate together, thereby increasing the loop per hook engagement ratio.

* * * * *